US011027860B2

(12) United States Patent
Williams

(10) Patent No.: US 11,027,860 B2
(45) Date of Patent: Jun. 8, 2021

(54) DELIVERY APPARATUS

(71) Applicant: Altria Client Services LLC, Richmond, VA (US)

(72) Inventor: Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 247 days.

(21) Appl. No.: 15/973,860

(22) Filed: May 8, 2018

(65) Prior Publication Data

US 2018/0257796 A1 Sep. 13, 2018

Related U.S. Application Data

(63) Continuation of application No. 13/546,649, filed on Jul. 11, 2012, now Pat. No. 9,963,253.

(Continued)

(51) Int. Cl.
*B65B 1/04* (2006.01)
*B65B 37/14* (2006.01)

(Continued)

(52) U.S. Cl.
CPC ..... *B65B 1/04* (2013.01); *B65B 1/30* (2013.01); *B65B 37/14* (2013.01); *B05B 11/00* (2013.01); *B65B 9/02* (2013.01)

(58) Field of Classification Search
CPC .. B65B 1/16; B65B 29/00; B65B 9/06; B65B 9/067; B65B 9/073; B65B 1/04;

(Continued)

(56) References Cited

U.S. PATENT DOCUMENTS 1,845,969 A 4/1928 Hueber
1,853,863 A * 4/1932 Hornbruch ..... F23D 14/60 431/90

(Continued)

FOREIGN PATENT DOCUMENTS

EP 0276628 A1 8/1988
EP 0982229 A1 3/2000

(Continued)

OTHER PUBLICATIONS

International Search Report and Written Opinion dated Sep. 28, 2012 for PCT/US2012/046237.

(Continued)

*Primary Examiner* — Andrew D StClair
(74) *Attorney, Agent, or Firm* — Harness, Dickey & Pierce, P.L.C.

(57) ABSTRACT

An air accelerator dosing tube for a form/fill/seal machine used to package fine cut tobacco material includes an axially-adjustable annular venturi communicating with the particulate material passage. A lining of polyether ether ketone optionally covers surfaces exposed to the particulate material. A metering assembly for delivering predetermined quantities of particulate material at predetermined time intervals may also be fabricated from polyether ether ketone. Each dosing tube is adapted for calibration by adjustment of the annular venturi to produce a predetermined force at a predetermined stand-off distance. In operation, consistent simultaneous operation of multiple dosing tubes, each of which has been calibrated, gives substantially uniform deposit of particulate material in pouch-type packages. The particulate material may include finely cut tobacco in addition to humectants, flavorants, and other tacky substances.

19 Claims, 5 Drawing Sheets

Related U.S. Application Data

(60) Provisional application No. 61/506,465, filed on Jul. 11, 2011.

(51) Int. Cl.
*B65B 1/30* (2006.01)
*B65B 9/02* (2006.01)
*B05B 11/00* (2006.01)

(58) Field of Classification Search
CPC .. B65B 1/30; B65B 37/14; B65B 9/02; A24B 13/00; B65G 53/14; B65G 53/42; B05B 11/00
USPC ..... 141/67; 131/111–119; 406/153
See application file for complete search history.

(56) References Cited

U.S. PATENT DOCUMENTS 2,145,941 A 2/1939 Maxfield
2,385,897 A 10/1945 Waters
2,832,615 A 11/1954 Summers
2,862,529 A 1/1956 Rosenblatt et al.
2,915,866 A 12/1959 Bartlo
3,027,695 A 4/1962 Leasure
3,050,430 A * 8/1962 Gallagher ..... A24D 3/0233 156/166
3,070,931 A 1/1963 Zwight
3,081,951 A 3/1963 Dyer et al.
3,173,188 A 3/1965 Wexler
3,381,441 A 5/1968 Condo, Jr. et al.
3,402,446 A * 9/1968 Benson ..... D02G 1/161 28/273
3,429,273 A 2/1969 Jones, Jr.
3,509,799 A 5/1970 Weis et al.
3,525,193 A 8/1970 Cutler et al.
3,637,447 A 1/1972 Berger et al.
4,079,662 A 3/1978 Puccetti et al.
4,111,212 A 9/1978 Bakker
4,135,615 A 1/1979 Brackmann et al.
4,144,041 A 3/1979 Hou
4,179,323 A 12/1979 Sigmon
4,228,900 A 10/1980 Lambach et al.
4,291,520 A 9/1981 Prince et al.
4,346,504 A * 8/1982 Birk ..... B65H 51/16 156/167
4,391,081 A 7/1983 Kovacs
4,468,845 A 9/1984 Harris
4,549,875 A 10/1985 Pryor
4,563,862 A 1/1986 McElvy
4,630,429 A 12/1986 Christine
4,703,765 A 11/1987 Paules et al.
4,757,668 A 7/1988 Klinkel et al.
4,807,814 A 2/1989 Douche et al.
4,860,959 A 8/1989 Handleman
4,869,048 A 9/1989 Boeckmann
5,012,629 A 5/1991 Rehman et al.
5,038,550 A 8/1991 Wirsig et al.
5,060,351 A 10/1991 Street
5,109,893 A 5/1992 Derby
5,174,088 A 12/1992 Focke et al.
5,247,779 A 9/1993 Wirsig et al.
5,279,098 A 1/1994 Fukuda
5,326,416 A 7/1994 Perrett
5,722,217 A 3/1998 Cloud
5,771,667 A 6/1998 McGregor et al.
5,873,680 A 2/1999 Huber et al.
5,937,614 A 8/1999 Watkins et al.
6,135,120 A 10/2000 Lofman et al.
6,237,308 B1 5/2001 Quintin et al.
6,261,030 B1 7/2001 Rassman, Jr. et al.
6,301,859 B1 10/2001 Nakamura et al.
6,347,499 B1 2/2002 McGregor et al.
6,417,676 B1 7/2002 Schroder et al.
6,550,226 B1 4/2003 Gates et al.
6,631,605 B1 10/2003 Quintin et al.
6,732,897 B2 5/2004 DeHart et al.
6,749,027 B1 6/2004 Crabtree et al.
6,982,094 B2 1/2006 Sowden
7,003,931 B2 2/2006 Gates et al.
7,134,256 B2 11/2006 Kujubu et al.
2003/0222372 A1 12/2003 Ward et al.
2004/0042857 A1 * 3/2004 DeHart ..... B65G 53/14 406/194
2006/0081723 A1 4/2006 Turberville
2007/0012328 A1 * 1/2007 Winterson ..... A24B 13/00 131/347
2007/0048097 A1 * 3/2007 Heckendorn ..... B65G 53/14 406/108
2010/0101189 A1 4/2010 Boldrini
2010/0163256 A1 7/2010 Williams
2011/0239591 A1 10/2011 Gruss et al.
2011/0277878 A1 11/2011 Williams
2011/0303232 A1 12/2011 Williams
2012/0000165 A1 1/2012 Williams

FOREIGN PATENT DOCUMENTS

EP 1637456 3/2006
WO WO-9008083 A1 * 7/1990 ..... B65G 53/58
WO WO 2009/021855 A1 2/2009
WO WO 2009/047627 A1 4/2009
WO WO 2010/051826 5/2010

OTHER PUBLICATIONS

International Preliminary Report on Patentability dated Jan. 14, 2014 for PCT/US2012/046237.

* cited by examiner

DELIVERY APPARATUS

CROSS REFERENCE TO RELATED APPLICATION

This application is a continuation application of U.S. patent application Ser. No. 13/546,649, filed Jul. 11, 2012, which claims priority under 35 U.S.C. § 119(e) to U.S. Provisional Application No. 61/506,465, filed on Jul. 11, 2011, the entire content of which is incorporated herein by reference thereto.

FIELD OF THE DISCLOSURE

This disclosure generally pertains to apparatus for metering material that includes particles. More specifically, this disclosure concerns apparatus having a compressed air acceleration.

Overview:

This disclosure has particular application to pouching machines used for forming and assembling pouches of particulate material, such as by way of example fine cut smokeless tobacco. Typical pouching machines simultaneously form and assemble, for example, ten pouches from a substantially continuous strip or web of pouch material and metered charges of prepared smokeless tobacco. To effect the simultaneous pouch assembly, pouching machines typically include a bank of generally vertical tobacco feed tubes. Typical pouching machines also include arrangements for drawing and directing a strip or ribbon of pouch web to each feed tube, and wrapping the strip around the corresponding feed tube to form a tubular formation, as well as arrangements to repetitively close and seal that tubular formation so as to form a lower transverse seam at a lower end portion of the tubular web formation just prior to charging each tubular formation with predetermined amount of smokeless tobacco. The pouching machine further includes arrangements for repetitively feeding individual charges of tobacco down corresponding feed tubes and into corresponding tubular formations. After each tobacco charge, the pouching machines close and seal the tubular formation at a second location above the tobacco charge to form an individual loaded and sealed pouch, which is then severed from the tubular formation.

Typically, smokeless tobacco material has a low moisture content, for example, about 30 to about 40% moisture level, and optionally includes flavorants, humectants and/or other tacky substances. Accordingly, smokeless tobacco has a tendency to stick to machine surfaces. Such smokeless tobacco is difficult to feed through pouch forming machines that rely merely on gravity feed techniques. Some pouching machinery incorporates pressurized air in the tobacco feed tubes to augment gravitational delivery of the smokeless tobacco charges. Because drier tobaccos are lighter than wetter tobaccos, the drier tobaccos have a greater tendency to scatter if subjected to jets of pressurized air during feeding, and that scatter can adversely affect the top seal on the associated pouch.

Prior pouching machines include a tobacco feed mechanism for repetitively discharging a predetermined amount of tobacco from a hopper or the like into a funnel at the upper end portion of a tobacco feed tube. Generally, if gravity is the only active force to move the tobacco down the feed tube, a charge of tobacco released into the tube forms into a column of tobacco traveling down the feed tube such that it is constrained along a significant path length that may be too long for proper filling operations. More particularly, not all of the entrained tobacco may have time to enter the confines of a partially closed pouch before the machine closes and seals the pouch along its upper transverse seam.

One solution has been to establish a Venturi arrangement at the base of the funnel. In this arrangement, pressurized air is introduced into the feed tube from a manifold through four to six or so small channels. Those small channels are fixed in size and may vary from tube to tube depending on machine tolerances and the like. Any clogging of one or more of the small channels tends to affect tobacco delivery for that feed tube in such a way that the bank of feed tubes performs inconsistently from one feed tube to another.

Another disadvantage of the foregoing arrangement that the small channels may impart a horizontal or transverse velocity component to the air being introduced through the small channels, with the result that some tobacco flow back may be caused.

It is desired to have the feed tubes of the bank of tobacco feed tubes operate consistently amongst one another so that filling operations across the entire bank are consistent with one another.

BRIEF DESCRIPTION OF THE DRAWINGS

The many innovative features and aspects of the present disclosure will be apparent to those skilled in the art when this specification is read in conjunction with the attached drawings wherein like reference numerals are applied to like elements and wherein.

DETAILED DESCRIPTION

Figure 1:
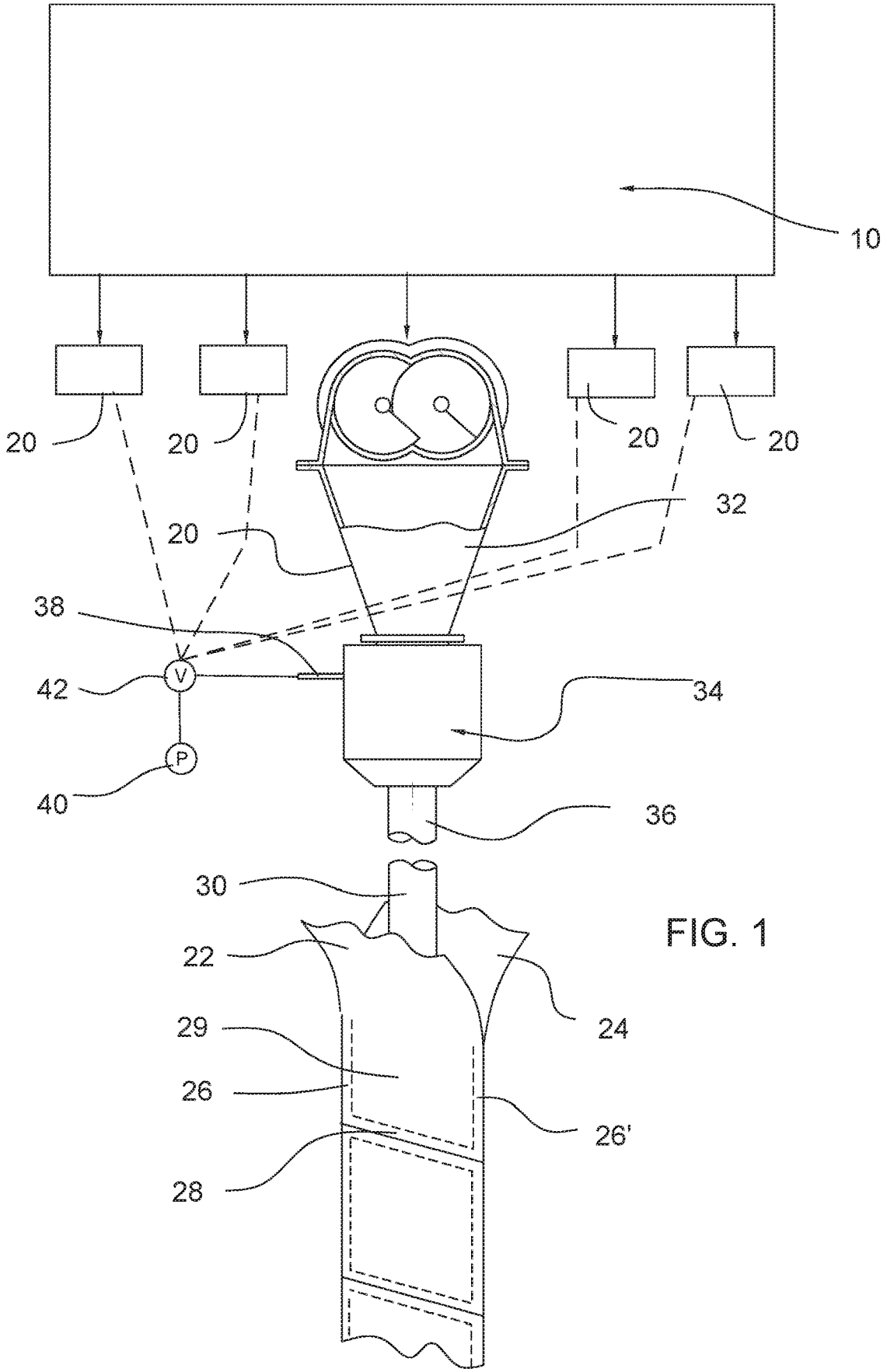
FIG. 1 is a schematic view in partial cross section of tobacco dosing apparatus.

In the production of pouched products, including for example and without limitation, smokeless tobacco products, continuous-motion packaging machinery is often used, and is commonly known as form/fill/seal equipment. Such machinery receives packaging material is substantially continuous strips, receives material to be pouched as a substantially continuous supply from a supply chamber, meters substantially uniform quantities of the material, partially forms a pouch, fills the metered material into the pouch, and finally seals the pouch such that the pouch surrounds that material. While various companies make such equipment, one such company is known as Ropak.

Typical form/fill/seal equipment produces pouched products in a plurality of parallel streams of packaging material and product. For example, 5, 10, or more parallel lanes may be provided. Operating speeds on the order of 100 cycles per minute are known for each of the parallel lanes. As may be expected, that actual manufacturing speed depends on, for example, product flow characteristics, packaging materials used, and temperature at which filling occurs.

In accord with this disclosure, a form/fill/seal apparatus 10 typically includes a plurality of suitable dose delivery apparatuses 20 (see FIG. 1) to deliver particulate material in predetermined quantities. Typically, the form/fill/seal apparatus 10 receives a quantity of material to be parsed into predetermined quantities of doses of that material, and then delivers each predetermined quantity of material to a dose delivery apparatus 20. The dose delivery apparatus 20 moves the predetermined quantity of material to a portion of the form/fill/seal apparatus where a pair of continuous webs 22, 24 have been joined with a transverse seal 28 and longitudinal edge seals 26, 26' so as to define a pocket or pouch 29. That pocket or pouch 29 is typically formed around the end 30 of a discharge tube of the dose delivery tube of a corresponding dose delivery apparatus 20. Alternatively, a single web may be folded into a tubular form about the dose delivery tube and sealed along a single longitudinal edge, whereupon transverse seals applied to the tubular structure define a pouch 29. Since the dose delivery apparatuses 20 are essentially identical, it will suffice to describe one in detail, with it being understood that the others are substantially the same. The principal difference from one dose apparatus 20 to another resides in its connection with the supply conduit.

Each dosing apparatus 20 may include a supply conduit 24 connected at one end to the form/fill/seal apparatus 10 and connected at the other end to metering apparatus 12. The metering apparatus 12 is operable to receive particulate material from the apparatus 10, parse the particulate material into predetermined portions, doses, or quantities, and then deliver those predetermined portions, doses, or quantities of particulate material to the upper end of the dose delivery apparatus 20 at predetermined time intervals. The predetermined time intervals are selected so that a dose is delivered to the dose delivery apparatus 20 as each partial pouch is ready to be filled.

While the metering apparatus 12 may take a variety of physical forms and arrangements, a presently preferred arrangement is depicted in FIG. 1. More specifically, the metering apparatus 12 preferably includes a pair of generally parallel feed screws 14*a*, 14*b* that are arranged so as to be generally perpendicular to the axis of the dose delivery apparatus 20. A suitable conventional drive mechanism is connected to at least one of the feed screws 14*a*, 14*b* such that the two feed screws rotate in the same direction about their respective axes. The drive mechanism is controlled, in a conventional manner, such that the feed screws intermittently rotate, with the time interval of the intermittent rotation being operable to define the predetermined dose of particulate tobacco material delivered to the dose delivery apparatus 20.

The feed screws 14*a*, 14*b* are preferably designed such that the flight of one screw cleans the flight of the adjacent screw as the two screws rotate. This characteristic of the feed screws 14*a*, 14*b* helps assure consistent weight and volume for the predetermined doses being delivered to the dose delivery apparatus 20. Furthermore, the feed screws 14*a*, 14*b* are preferably fabricated from polyether ether ketone (PEEK).

Figure 1A:
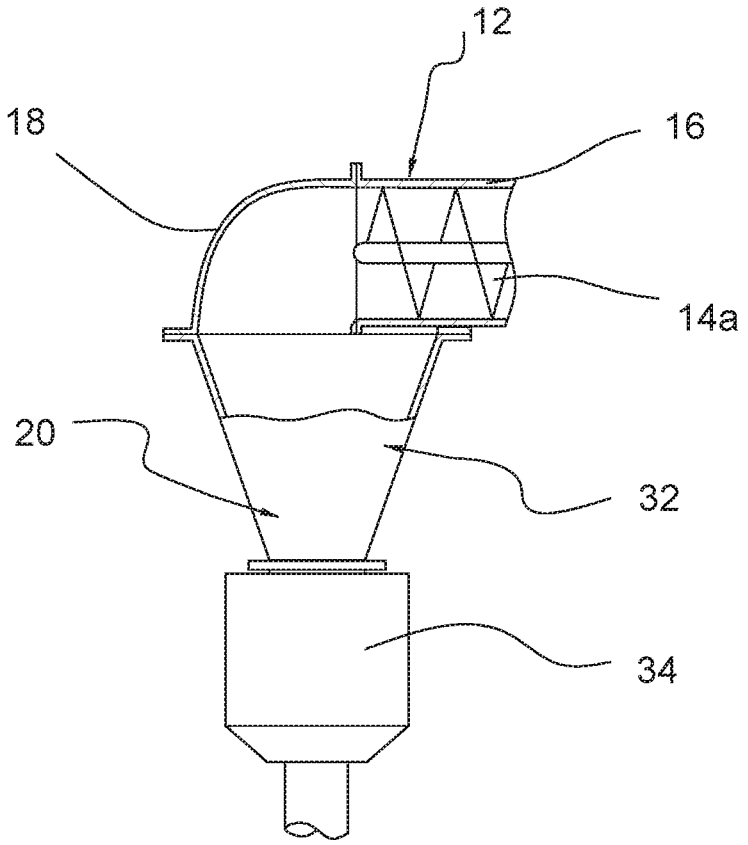
FIG. 1A is a partial cross-sectional view of the feed apparatus of FIG. 1.

The metering apparatus 12 also includes a housing 16 (see FIG. 1A) within which the feed screws 14*a*, 14*b* are positioned and within which those feed screws are mounted for rotation. The discharge end of the housing 16 is positioned above the inlet to the dose delivery apparatus 20, and may be offset from both the center and the edge as depicted so that particulate tobacco material of a given dose can drop directly in to dose delivery apparatus 20. The housing 16 closely conforms to the peripheral edge of the flight of each feed screw 14*a*, 14*b* so that particulate material does not spill over the edge of the flight and dosing quantity is thus controlled. Preferably, the housing 16 is also fabricated from PEEK.

The discharge end of the housing 16 is connected to a snout 18 which encloses the end of the housing and couples the housing 16 to the upper end of the funnel 32 of the dose delivery apparatus 20. The snout 18 assures that particulate tobacco material delivered to the dose delivery apparatus 20 by the feed screws 14*a*, 14*b* does not escape and falls into the dose delivery apparatus 20. In addition, the snout 18 is effective to avoid any external contamination of the particulate tobacco material passing therethrough. The snout 18 is also preferably fabricated from PEEK.

The use of PEEK as a preferred material for fabrication of the feed screws 14*a*, 14*b*, the housing 16, and the snout 18 has several advantageous and desirable attributes. PEEK functions as a thermal insulator. Thus, use of PEEK between the delivery apparatus 10 and the dose delivery apparatus 20 functions to substantially thermally insulated those apparatuses from one another. Moreover, PEEK substantially reduces and effectively avoids sticking of the particulate tobacco material to the surfaces of the housing, the feed screws, and the snout. Especially where the apparatus must be disassembled and cleaned on a regular basis (e.g., daily), this attribute is highly advantageous because it can reduce the cleaning time and thus add more processing time to the apparatus.

For purposes of this disclosure, the particulate material may be particulate tobacco that has optionally been blended with other components including, for example, flavorants, humectants, and/or other substances, some or all of which may be tacky or may add tackiness to the particulate tobacco. The particulate tobacco material may include fine cut tobacco that has been comminuted at about 70 cuts per inch. Preferred particulate tobacco material may include up to about 39% oven volatiles.

The snout 18 of the metering apparatus 12 attaches to a supply funnel 32 (see FIG. 1) at the inlet of the dose delivery assembly 20. Preferably, the supply funnel 32 is circularly symmetric about an axis passing therethrough. At the bottom end of the supply funnel 32, and in communication with the interior of the supply funnel, an air accelerator assembly 34 is provided. This air accelerator assembly 34 is operable to provide continuous or pulsed flow of particulate tobacco material. To that end, the air accelerator assembly 34 connects with an air supply conduit 38, which in turn receives pressurized air from an air supply 40. The air supply 40 may be a pump, air compressor, plenum chamber, or the like, as may be desired or appropriate for a particular application. A valve 42 may be in fluid communication with the air supply 40 and the air accelerator assembly 34. As desired, the valve 42 may be operable to interrupt air flow to the air accelerator assembly 34 so as to start, stop, and/or pulse air delivered to the air accelerator assembly 34. Typically, air at ambient temperature and pressure in the range of 4-18 psig has been found to be suitable for use with an air accelerator assembly 34 of the type described herein.

At the bottom end, the air accelerator assembly 34 attaches to a dosing tube 36. That dosing tube 36 preferably terminates in a position where the pouch has been partially formed and can receive particulate material from the discharge end of the dosing tube 36.

The air accelerator assembly 34 includes a body 50, and an internal member 52 which is axially adjustable with respect to the body 50 along an axis 54. Preferably, the funnel member 32 is rotationally symmetric about the axis 54. Internal surfaces of the body 50 that are exposed to air flow, as well as surfaces of the internal member 52 that are exposed to air flow or to product flow are also rotationally symmetric with respect to the axis 54.

The narrow or lower end of the funnel member 32 preferably includes a radially extending flange 56 having a periphery that corresponds to the outer peripheral surface of the body 50. In addition, the flange 56 of the funnel member 32 includes a radially extending annular face 64 which is configured to mate with a corresponding radially extending annular face 66 at the upper end of the body 50. The flange 56 preferably also includes a projecting land 68 which is received in a threaded bore 70 of the body 50. Cooperation between the projecting land 68 and the associated bore 70 assures that the body 50 and the funnel member 32 are coaxial when joined together. To that end, a plurality of axially extending bolts, or threaded fasteners 58, may be used to attach the flange 56 and the body 50. Suitable gasket material may be provided between the abutting surfaces 64, 66 of the flange 56 and the body 50, respectively, if desired.

Extending longitudinally through the body 50, along the axis 54, is a body cavity that includes a threaded, generally cylindrical portion adjacent the funnel member 32, a frustoconical portion 72 extending downstream from the threaded portion, and a discharge tube connection portion at the lower or bottom end of the body 50. The frustoconical portion 72 essentially matches the diameter of the threaded portion at it upstream end. In addition, the downstream or lower end of the frustoconical portion 72 is preferably sized to have a diameter corresponding to the inside diameter of the discharge tube 36. The discharge tube 36 is preferably attached to the downstream end of the body 50 using a suitable conventional attachment. For example, any of a threaded connection, a welded connection, or an adhesively bonded and sealed connection would be satisfactory.

Turning to the longitudinally movable or adjustable member 52 of the air accelerator assembly 34, the adjustable member 52 includes a generally cylindrical longitudinal bore 80 extending from the upstream end to the downstream end of the adjustable member 52. The longitudinal bore 80 preferably has a diameter corresponding to the opening at the discharge end of the funnel member 32 so that particulate material can move downwardly through the funnel member 32 and into the longitudinal bore 80 substantially free of impediment.

The upper or upstream end of the adjustable member 52 includes a flange portion 84 preferably having a peripherally threaded portion that mates with the threaded portion of the cavity in the body 50. Cooperation between the externally threaded flange 84 and the internally threaded portion of the body cavity not only secures the adjustable member 52 in the body 50, but also allows the adjustable member 52 to have its spatial relationship with the body 50 controlled in the longitudinal direction along the axis 54.

Preferably, the exterior surface of the adjustable member 52 also includes a frustoconical surface 82 extending from the flange 84 to the distal end 88 at the downstream end of the adjustable member 52. Preferably, the frustoconical surface 82 meets the longitudinal bore 80 at the distal end 88 of the adjustable member 52 so that an acute sharp angle is defined in the material of the adjustable member 52. Both the frustoconical surface 82 of the adjustable member 52 and the frustoconical portion of the cavity in the body 50 are preferably polished. Because the facing frustoconical surfaces define a chamber for pressurized air, and because it is desirable to accurately control the flow rate of pressurized air through that chamber, it is believed to be important that those facing frustoconical surfaces be as smooth as possible so as to avoid creating inconsistent resistance to air flow from one air accelerator assembly 34 to another. Accordingly, these facing frustoconical surfaces may be honed and/or polished so that the surface roughness is about 100 microinches or less, and preferably about 30 microinches of less.

Figure 3:
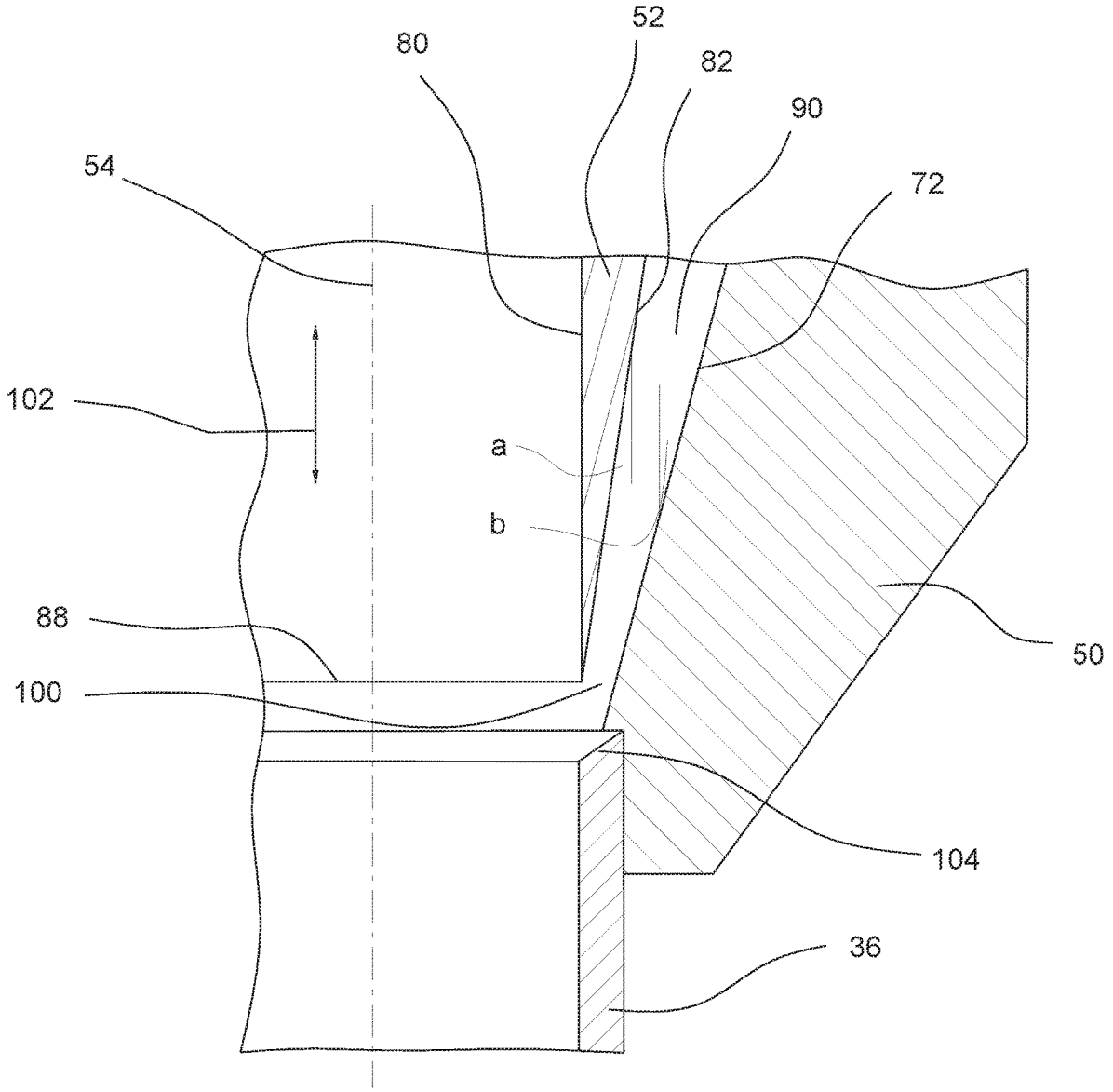
FIG. 3 is a detail view of the venturi discharge for the air accelerator unit of the dose delivery apparatus.
Figure 4:
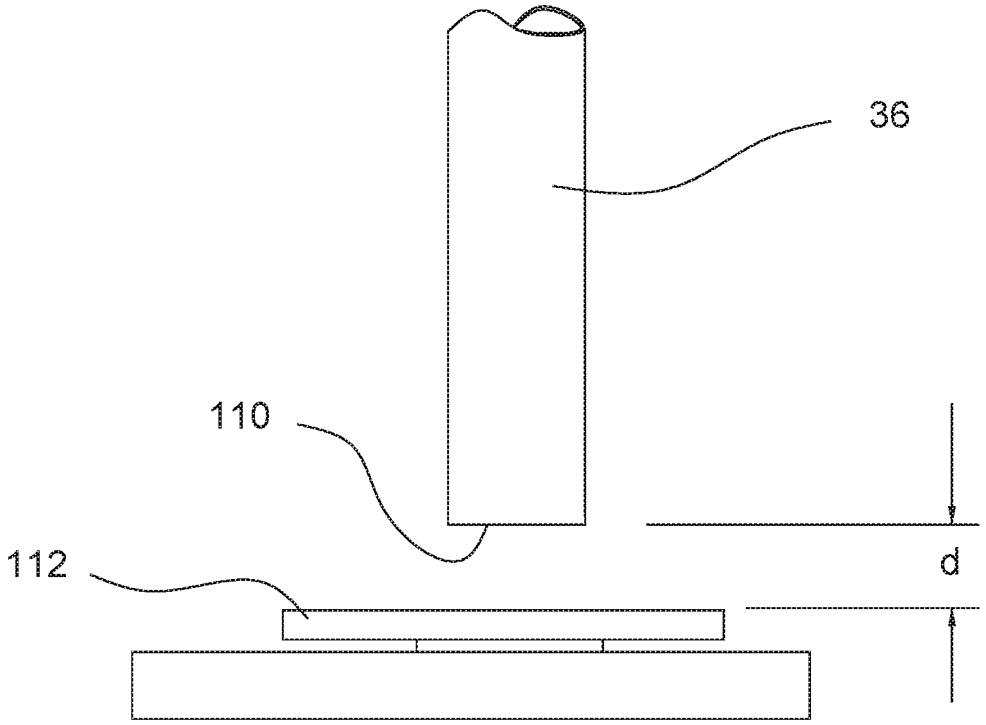
FIG. 4 is a schematic illustration of a calibration set-up.

As noted, the cavity of the body 50 and the frustoconical surface 82 of the adjustable member 52 cooperate to define a chamber 90 for pressurized air. That chamber 90 has fluid communication with the conduit 38, and thus the pump 40 and associated control valve 42 (see FIG. 1). The frustoconical surface 82 (see FIG. 3) of the adjustable member defines an angle a with the axis 54 of its central bore 80. The frustoconical surface portion 72 of the cavity in the body 50 has an angle b with the axis 54. The distal end 88 of the adjustable member 52 cooperates with the frustoconical surface portion 72 of the cavity in the body 50 to define a throat or minimum flow area at the downstream end of the chamber 90. To assure that the flow area through the chamber 90 decreases as air moves downstream toward the throat, the angle a must be less than the angle b. Thus, the chamber 90 (see FIG. 3) effectively comprises a venturi through which pressurized air in the chamber 90 passes as it moves toward and through the reduced area throat 100 (outlet of the chamber 90). With the longitudinal adjustability of the member 52 in the direction of the arrow 102, the throat 100 can be adjusted as described more fully below to calibrate and adjust the various air acceleration assemblies of a form/fill/seal machine.

Figure 2:
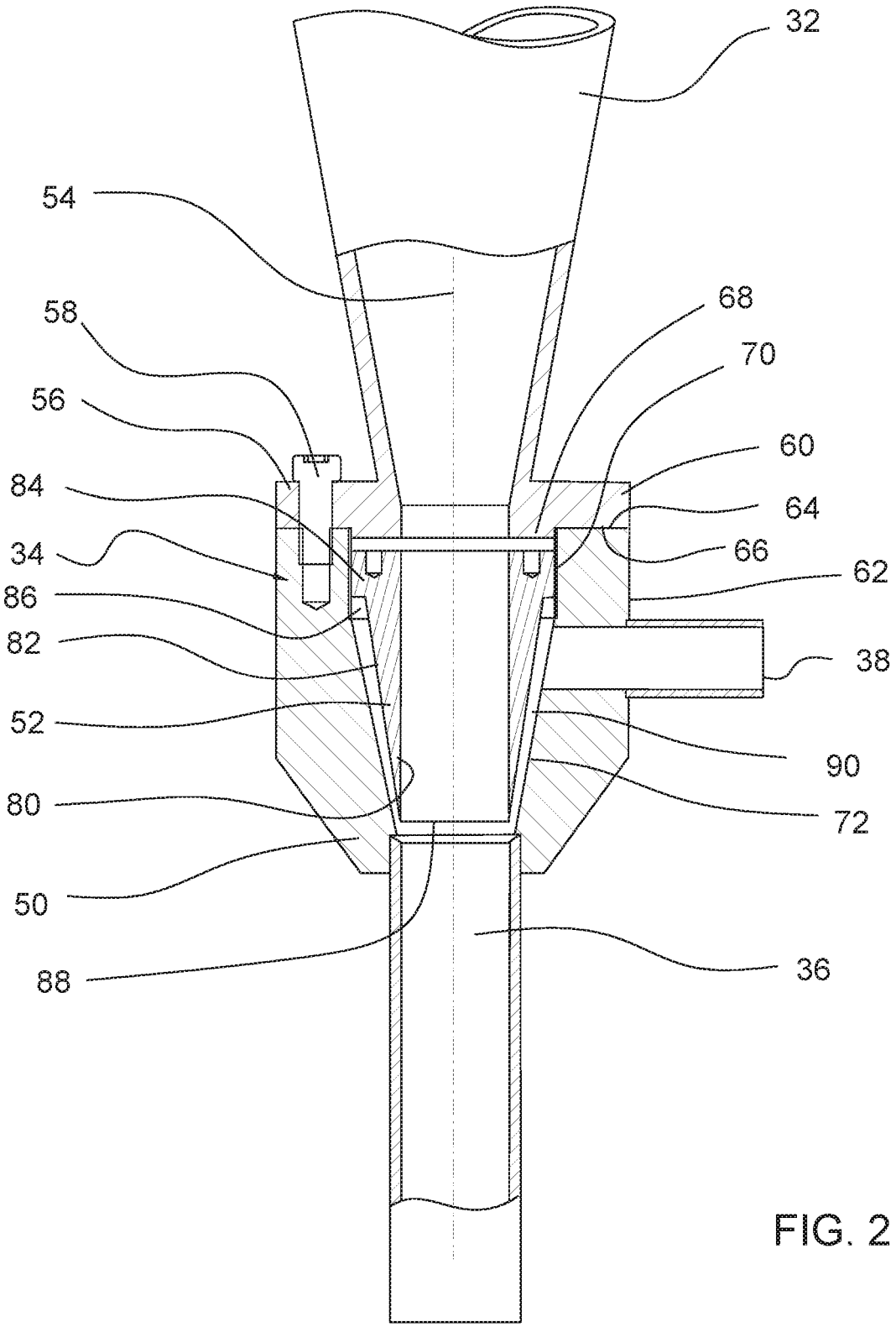
FIG. 2 is an enlarged, partial cross-sectional view taken through the dose delivery apparatus of FIG. 1.

Since it is also important that air supplied to the chamber 90 (see FIG. 2) through the conduit 38 be constrained to pass out of the chamber 90 only through the throat 100, a suitable conventional gasket 86 may be provided at the upper end of the chamber 90 between the flange 84 of the adjustable member 52 and the cavity of the body 50.

In a preferred embodiment, the body 50 and the adjustable member 52 are constructed from air-hardened tool steel.

As noted above, the particulate tobacco material processed through the dosing tube assembly described above may exhibit tackiness. Accordingly, one or more of the interior surface of the funnel member 32, the cylindrical channel 80 of the adjustable member 52, and the interior of the discharge tube 36 may also be coated with polyether ether ketone (PEEK). More preferably, the adjustable member 52 may be constructed entirely from PEEK. Such a coating can improve mechanical and chemical resistance to the particulate material as that material moves through the dosing tube assembly.

It will now be understood by those skilled in the art that the tapered angle b of the adjustable member 52 (see FIG. 2) is greater than the corresponding taper angle a of the frustoconical channel of the body 50 such that as the member 52 is threaded into the body 50 a tapered convergent chamber 80 is defined around a portion of the adjustable member 52 in the space provided between the body 50 and the member 52. As the member 52 is threaded further and further into the body 50, the annular discharge orifice or throat 100 at the distal end 88 of the member 52, and near the base of the body 50, becomes smaller and smaller.

Conventional set screws may be provided as a locking means to fix or otherwise lock the relative positions of the member 52 and the body 50.

To prepare an air acceleration assembly 34 for use, the assembly 34 and its discharge tube 36 are removed from the tobacco feed system. Then the assembly 34 is calibrated by adjusting the throat of the variable venturi such that a predetermined force is obtained from the associated discharge tube. To that end, the assembly 34 with its discharge tube 36 is positioned in a fixture such that the end 36 at the base of the discharge tube 36 is proximately positioned relative to a suitable conventional a precision scale 112. The discharge tube 36 is held at a predetermined stand-off distance d above the surface of the precision scale 112. Preferably that predetermined stand-off distance d between the end of the discharge tube 36 and the precision scale 112 is about 1 mm.

The feed tube is connected to the source 40 of pressurized air through the conduit 38 (see FIG. 1) and the pressure regulator 42. The pressure regulator is adjusted to a desired operating pressure for the tobacco pouching machine, for example eighteen psig. Then the longitudinally adjustable member 52 is rotated so that it can be adjusted either up or down relative to the body 50 until the discharge of air through the discharge tube onto the precision scale registers a reading of a predetermined force, preferably in the range of about 20 to about 30 g. For example, the predetermined force or target scale reading might be 25 g. Once body 50 and member 52 have been adjusted so that the desired force reading is obtained, the member 52 is locked in place relative to the body 50 by a set screw or other suitable mechanism to fix the relative position of the body 50 and the member 52. While a mechanical locking arrangement such as a set screw may be used, the relative positions of the member 52 and the body 50 are most preferably permanently attached to one another, as by welding, so that the calibration is fixed. Otherwise, when the feed tube is cleaned (typically a daily occurrence), recalibration is required. The foregoing steps are repeated for each remaining air acceleration assembly 34 until all assemblies 34 have been calibrated to provide the same predetermined force.

After each air acceleration assembly 34 has been calibrated and returned to the tobacco feed mechanism, the pouching machine, i.e., the form/fill/seal machine, is ready for operation. Typically, a machine operator adjusts the air regulator 42 (FIG. 1) of the pouching machine to achieve desired pouch loading operation across the bank of feed tubes.

At one extreme, the air pressure may be too high, in which case the tobacco is driven into the pouch with such force that the pouch tends to open or cause tobacco to enter the first lower transverse seal of the pouch being formed. In another case, the pressure may be too low such that the upper transfer seam is closed and sealing initiated before all the tobacco has fully arrived into the body portion of the pouch. For this latter condition, the operator typically increases the operating pressure. Once the filling sequence has been optimized, the operator is assured uniform filling across the bank of feed tubes, because each air acceleration assembly has been calibrated the same way.

Preferably, the operating pressure of all feed lanes (or delivery apparatuses 20) is adjustable from a single, common regulator 42. Such arrangement contributes uniform tobacco feeding characteristics across the entire bank of feed lanes to enhance machine operation and performance. The arrangement assures that downstream timing requirements are uniformly met. For example the cutting knives for severing fully formed pouches operate uniformly at a fixed rate across the entire bank of feed lanes. The feed system as taught herein, with its locking down each air delivery system to a common, uniform calibration and uniform adjustment of operating pressure from a common regulator assures that tobacco is delivered at the right time and at the right speed across the bank of feed lanes. During operations, should delivery speed of the feed lanes drift, the operator may return the entire bank of feed lanes back into desired delivery speed by observing a single feed lane while adjusting the common regulator.

In this description, the word "substantially" is used as an adjective to show that the modified term need not be used literally, but is intended to include equivalent terms which do not materially depart from the spirit and scope of the term. When the word "substantially" is used in connection with a geometric term, it is intended that the geometric term not be interpreted rigidly with respect to geometric definitions.

To similar effect, the word "about" is used in this description in connection with numerical terms to demonstrate that mathematical precision is not required and that a tolerance of ±10% around that numerical term is intended.

It will now be apparent to those skilled in the art that this specification provides a novel and unobvious improvement to a metering device for particulate material, particularly where pressurized fluid functions to assist movement of the particulate material through the apparatus. Furthermore, it will be apparent to those skilled in the art that numerous modifications, variations, substitutions, and legal equivalents exist for features of the invention described herein. Accordingly, it is expressly intended that all such modifications, variations, substitution, and legal equivalents that fall within the spirit and scope of the appended claims be embraced thereby.

What is claimed is:

1. A delivery apparatus, comprising:

a body with an upper mounting surface and a lower end, the body including an interior surface that defines a body cavity within the body, the body cavity traversing through the upper mounting surface and the lower end to respectively define a first inlet and a first outlet in the upper mounting surface and the lower end, the interior surface defining a threaded bore portion and a frustoconical inner surface, the frustoconical inner surface abutting the threaded bore portion and extending inwardly and downwardly from the threaded bore portion;

an adjustable member positionable within the body cavity, the adjustable member defining a bore that extends longitudinally though the adjustable member, the bore traversing through a first end and a second end of the adjustable member to respectively define a second inlet and a second outlet, the adjustable member including an upper portion configured to be received in the threaded bore portion to respectively align the second inlet and the second outlet within the first inlet and the first outlet, the adjustable member being axially movable between the first inlet and the first outlet, the adjustable member including a frustoconical external surface that extends downwardly and inwardly from the upper portion, the body and the adjustable member combining to define an air chamber between the frustoconical external surface and the frustoconical inner surface, the frustoconical external surface and the frustoconical inner surface further defining a throat at a third outlet of the air chamber, the body and the adjustable member being configured to pass pressurized air through the throat toward the first outlet, the throat being adjustable via an axial movement of the adjustable member to adjust a delivery of the pressurized air from the air chamber toward the first outlet; and a funnel with a projecting land, the upper mounting surface configured to receive the projecting land to coaxially align the first inlet and the second inlet with a fourth outlet of the funnel, the projecting land being configured to be disposed in the upper mounting surface, a first major surface of the projecting land and a second major surface of the adjustable member being configured to define an annular gap therebetween.

2. The delivery apparatus of claim 1, wherein the frustoconical external surface and the frustoconical inner surface converge toward the first outlet.

3. The delivery apparatus of claim 2, wherein the throat is defined between a distal-most end of the adjustable member and the frustoconical inner surface.

4. The delivery apparatus of claim 1, wherein the upper portion includes a threaded flange that is configured to engage the threaded bore portion to allow the axial movement of the adjustable member within the body cavity.

5. The delivery apparatus of claim 1, wherein the body further defines a dosing tube connection portion at the lower end, the dosing tube connection portion being configured to receive a dosing tube and maintain the dosing tube in fluid communication with the first outlet.

6. The delivery apparatus of claim 5, further comprising:

the dosing tube, wherein the dosing tube is one of welded on the dosing tube connection portion, connected to the dosing tube connection portion via a screw thread connection, or combinations thereof.

7. The delivery apparatus of claim 1, wherein the body includes an air supply conduit in fluid communication with the air chamber.

8. The delivery apparatus of claim 1, wherein the projecting land surrounds the fourth outlet.

9. The delivery apparatus of claim 8, wherein an end of the funnel includes a radially extending flange, the radially extending flange having a surface configured to attach to the upper mounting surface.

10. The delivery apparatus of claim 8, wherein the fourth outlet has a first diameter corresponding to a second diameter of the second inlet.

11. The delivery apparatus of claim 1, further comprising:

a gasket, the gasket being configured to seal mating surfaces between the upper portion and the body.

12. The delivery apparatus of claim 1, wherein the frustoconical external surface is a polished surface.

13. The delivery apparatus of claim 1, wherein the frustoconical inner surface is a polished surface.

14. A calibrated delivery apparatus, comprising:

the delivery apparatus of claim 1, wherein the adjustable member is welded to the body within the body cavity in a calibrated position.

15. An assembly comprising:

a plurality of delivery apparatuses each being in accordance with the delivery apparatus of claim 1, wherein each of the plurality of delivery apparatuses is configured to be in fluid communication with a common pressurized air source via a pressure regulator valve, the plurality of delivery apparatuses being configured to deliver particulate material into partially formed pouches.

16. The assembly of claim 15, wherein each of the plurality of delivery apparatuses is connected to a metering apparatus via a respective funnel.

17. The assembly of claim 15, further comprising:

a common pressurized air source connected to a pressure regulator valve, the common pressurized air source being in fluid communication with each of the plurality of delivery apparatuses via the pressure regulator valve.

18. A method of calibrating the delivery apparatus of claim 1, the method comprising:

axially moving the adjustable member within the body cavity to position the throat to a calibrated position; and fixing the adjustable member in a fixed position within the body once the throat is in the calibrated position.

19. The delivery apparatus of claim 1, wherein an entirety of the frustoconical inner surface exists at a first angle relative to an imaginary centerline, an entirety of the frustoconical external surface exists at a second angle relative to the imaginary centerline, the imaginary centerline being a centerline of the bore if the body is holding the adjustable member within the body, and the first angle is greater than the second angle.

* * * * *